US005415293A

United States Patent [19]

Ackermann et al.

[11] Patent Number: 5,415,293

[45] Date of Patent: May 16, 1995

[54] GRAPE LUG

[75] Inventors: Jeff Ackermann, Manhattan Beach, Calif.; William P. Apps, Alpharetta, Ga.; Cory Philips, Manhattan Beach, Calif.

[73] Assignee: Rehrig-Pacific Company, Inc., Los Angeles, Calif.

[21] Appl. No.: 113,336

[22] Filed: Aug. 30, 1993

[51] Int. Cl.[6] ..... B65D 21/04

[52] U.S. Cl. ..... 206/506; 206/205; 206/509; 220/675

[58] Field of Search ..... 206/505, 506, 507, 509, 206/511, 512, 503, 515, 518, 519; 220/676, 675, 670, 671, 23.6

[56] References Cited

U.S. PATENT DOCUMENTS

| | | | |
|---|---|---|---|
| Re. 26,350 | 2/1968 | Wilson | 206/505 |
| D. 197,091 | 12/1963 | Crane | D58/4 |
| D. 197,311 | 1/1964 | Spaak et al. | D58/12.6 |
| D. 198,594 | 7/1964 | Casteliano | D58/12.6 |
| D. 248,280 | 6/1978 | Martin | D9/243 |
| D. 252,172 | 6/1979 | Carroll et al. | D3/67 |
| D. 259,400 | 6/1981 | Carroll et al. | D99/44 |
| D. 266,914 | 11/1982 | Miller | D11/155 |

(List continued on next page.)

FOREIGN PATENT DOCUMENTS

| | | | |
|---|---|---|---|
| 675843 | 12/1963 | Canada | 190/26 |
| 778627 | 2/1968 | Canada | 190/73.5 |
| 1022090 | 12/1977 | Canada | 190/34.3 |
| 2332920 | 7/1977 | France | 206/507 |

(List continued on next page.)

OTHER PUBLICATIONS

Kader & Mitchell, "Postharvest Technology of Horticultural Crops", Pub. No. 3311, pp. 56–58, 1992.

"Vicrate 32" product literature, Viscount Consolidated Industries Pty Ltd., Victoria, 4 pages, Undated.

(List continued on next page.)

*Primary Examiner*—Stephen J. Castellano

*Attorney, Agent, or Firm*—Banner, Birch, McKie & Beckett

[57] ABSTRACT

A stackable and nestable container is provided which comprises a bottom surface and two pairs of opposed side walls integrally joined with the bottom surface and each other to form a substantially rectangular open-top container. The uppermost surfaces of the side walls collectively form an upper container rim. A container lid is adapted to be received along the upper container rim. Ventilation apertures are formed in each of the side walls. Also, each side wall includes a pair of column sections. Each column section includes a recessed portion, an inner shelf, and a lower column support. The column sections form outer surfaces which project outwardly away from the side walls. By using the column section design, all the support geometry for the container is located in the corners of the container. The upper container rim comprises a double thickness of material around substantially its entire periphery. The upper container rim comprises a single thickness of material only along those surfaces located adjacent to the recessed portions of the column sections. With this design, the double thickness construction of substantially the entire upper container rim provides the container with sufficient high strength for stacking. Further, the single thickness recessed portions of the column sections provide suitable surfaces for a nesting configuration. However, the high strength of the container is maintained in potentially weak single thickness areas by the double thickness construction of the lower column supports. Also, with the double to single thickness design, the outer surfaces of the column sections are configured so as to closely abut the column sections of a similarly shaped container when the containers are juxtaposed.

20 Claims, 11 Drawing Sheets

U.S. PATENT DOCUMENTS

| | | | |
|---|---|---|---|
| D. 274,967 | 8/1964 | Taylor | D6/510 |
| D. 302,620 | 8/1989 | Quong | D34/40 |
| D. 328,662 | 8/1992 | Maglione | D34/40 |
| 2,064,518 | 12/1936 | Brogden | 220/97 |
| 2,695,115 | 11/1954 | Roop | 220/42 |
| 3,113,680 | 12/1963 | Frater et al. | 206/507 |
| 3,270,913 | 9/1966 | Bridenstine et al. | 220/97 |
| 3,326,410 | 6/1967 | Asenbauer | 220/97 |
| 3,331,529 | 7/1967 | Slapnik | 220/97 |
| 3,351,229 | 11/1967 | Bridenstine | 220/97 |
| 3,360,162 | 12/1967 | Miles | 220/97 |
| 3,420,402 | 1/1969 | Frater et al. | 220/97 |
| 3,447,715 | 6/1969 | Beney | 220/97 |
| 3,481,502 | 12/1969 | Slayman | 217/42 |
| 3,547,309 | 12/1970 | Pusey et al. . | |
| 3,682,351 | 8/1972 | De Putter | 220/97 B |
| 3,700,137 | 10/1972 | Souza | 220/97 E |
| 3,734,341 | 5/1973 | Levenhagen | 220/97 D |
| 3,759,416 | 9/1973 | Constantine | 220/97 F |
| 3,773,213 | 11/1973 | Frederick | 220/97 D |
| 4,000,817 | 1/1977 | Sanders et al. | 206/505 |
| 4,027,796 | 6/1977 | Martin | 206/507 |
| 4,105,117 | 8/1978 | Atkin et al. | 206/501 |
| 4,189,052 | 2/1980 | Carroll et al. | 206/507 |
| 4,225,046 | 9/1980 | Ettema | 206/511 |
| 4,478,344 | 10/1984 | Rehrig | 220/676 |
| 4,759,451 | 7/1988 | Apps | 206/507 |
| 4,848,580 | 7/1989 | Wise | 206/519 |
| 5,031,761 | 7/1991 | De Larosiere | 206/203 |
| 5,042,674 | 8/1991 | Ramsay et al. | 206/505 |

FOREIGN PATENT DOCUMENTS

| | | | |
|---|---|---|---|
| 2504889 | 1/1982 | France | 206/507 |
| 2547561 | 12/1984 | France . | |
| 2223481 | 4/1990 | United Kingdom | 206/506 |
| 2227232 | 7/1990 | United Kingdom . | |

OTHER PUBLICATIONS

"Product Information Bulletin–Viscount 32 Litre Crate", Viscount Consolidated Industries Pty Ltd., Victoria, Australia, 2 pages, Undated.

Article Entitled "Cooling Table Grapes", pp. 40, 44–48, Author Unknown, Undated.

GRAPE LUG

BACKGROUND OF THE INVENTION

1. Field of the Invention

The present invention relates to stackable and nestable open-top containers and, more particularly, to a container which is specifically adapted to receive perishable food items which require circulation of a cooled air flow.

Table grapes must be cooled promptly and thoroughly after harvest to maintain satisfactory quality. The grapes must be cooled immediately to (1) minimize water loss from the fruit, (2) retard the development of decay caused by fungi, and (3) reduce the rate of respiration of the fruit. Thus, immediately after harvesting, grapes are packaged in a container, or a "lug" as it is referred to in the art, and shipped to a temporary storage facility so that they may be cooled to a desirable temperature.

There are three general methods of cooling grapes in the temporary storage facility. These methods differ in the manner in which the cooling air is brought into contact with the fruit in the lug.

A first method is commonly known as conduction. In this process, cooled air is delivered to an unvented lug. Cooling of the fruit is effected strictly through the naturally occurring conduction process. The grapes which are in contact with a cold unvented liner are cooled by conduction. That fruit in turn extracts the heat from the grapes deeper in the container by the same process. No air movement is involved within the lug.

A second method is known as parallel flow cooling. In this method, cooling air is delivered by fans on the side of the storage room to palletized fruit. Two sides of each pallet are exposed to the air flow. Alternatively, the cooling air is delivered downward from ceiling jets placed between pallets with four sides exposed. The parallel-flow method may be regarded as approaching natural-convection cooling. Here, the velocity of the air along the sides of the containers causes turbulence that results in air exchange through the vents of the package.

Finally, a third and preferred method is known as forced air cooling. In this method, air is delivered directly to the fruit by establishing a pressure gradient across the lugs placed on a pallet. The forced-air method may be considered as simply forced-convection cooling.

Each of the above methods has advantages and disadvantages; however, they differ widely in the rate and effectiveness of cooling the grapes. Particularly, there is a close relationship between the cooling rate and the accessibility of the fruit to the cooling air. When the fruit itself is brought into close contact with the air such as in the forced air cooling method, the cooling time is drastically reduced.

Forced-air cooling is advantageous because the short length of the cooling period makes it possible to cool and ship fruit the same day that it is harvested and packed. When forced air cooling is used, the grapes can be super cooled to 32° F. in about 2 hours. This time is critical to the storage life of the grapes and it is also imperative to reduce the bottle-neck in grape warehousing.

FIG. 5 illustrates the principle of the forced air cooling method. In the forced air cooling process, a vacuum is created on one side of a wall of pallets of grapes while cold air is pumped in from the other side of the pallets.

Air pulled by the fan from the refrigeration compartment (ice, coils, spray, or packed column) is forced through the fruit packs from one side of the lug to the other before returning to the compartment.

The rate of cooling with the forced air cooling process is greatly increased over that of the parallel-flow system because, the cooling air is brought directly to the fruit in the package rather than just to the package. By setting up a pressure gradient across the package, there is a positive flow of cooling air through the container from one side to the other providing direct contact with the packed fruit.

FIGS. 6 and 7 show a forced-air cooling system in operation. In place are eight pallets each containing stacks of six containers each thereon. A plurality of pallets may be stacked one upon another on this configuration.

A vacuum is located to one side of the stacked pallet configuration. A flexible baffle or liner is used to enclose the open space between the stacked pallets from above and at the end opposite the vacuum. In this manner, a plenum chamber is formed in the open space between the separated rows of pallets.

When the vacuum is operated, air is drawn between the two rows of pallets into the plenum chamber. The pressure gradient of the forced air cooling system flows (in the direction of the arrows) across the three containers stacked in abutting relation to each other. Thus, the vacuum draws cooled air from the outer room through the three juxtaposed lugs and up and over the grapes into the plenum chamber.

2. Description of The Prior Art

Growers of table grapes currently use three different types of containers to package and ship table grapes. These known containers utilize wood, corrugated cardboard or polystyrene. There is a consensus among the growers and receivers of grapes that the table grape containers now in use could use improvement. With the increasing concern for recycling as well as the rising price of wood, the desirability of a plastic one way shipping container for table grapes manufactured with recycled material is very high.

The primary shipping container now, used is called a TKV container which is made of wooden ends and a combination of paper and thin wood for the long side walls and bottom. The wooden TKV container is a popular package because it can be stacked in a configuration three pallets high. The TKV package is also popular because it can successfully be utilized in a cold storage facility for an extended period of time.

Prior art alternatives to the wooden TKV box are wax impregnated corrugated cardboard and foam polystyrene. The corrugated cardboard box is a short term shipping container which is used in applications where the grapes are usually picked and shipped within a period of one week. However, corrugated cardboard has a tendency to absorb moisture and fall apart. In addition, corrugated cardboard cannot be stacked in a configuration three pallets high because of limitations on the strength of the corrugated cardboard. Similarly, the polystyrene box does not stack three pallets high and has recycling limitations.

As discussed above, the specific construction of the container used to ship grapes is important to successful fruit harvesting, cooling, storage and shipping. Moreover, when using the preferred forced air cooling process, the design of the container used to hold the grapes is critical. Air that bypasses the fruit pack has little cooling effect and therefore does little to reduce the length of the required cooling period. In addition, even relatively small openings around the packages can increase significantly the fan capacity required to maintain a given static-pressure difference.

For example, prior art TKV containers have been used to store grapes temporarily during the forced air cooling process. However, when TKV containers are used, spacers or cleats are inserted between juxtaposed containers which are stacked on top of one another. Also, there are cleats on the lids, necessary for attachment. With this arrangement, a substantial amount of the cooling air flow is lost between the stacked TKV containers. Because the cooling air flow directed at the containers will follow the path of least resistance, a large quantity cooling air naturally flows between the containers into the open areas created by the spacers or cleats, as shown, for example, in FIG. 1A. Accordingly, because a large quantity of air is lost, the volume of cooling air required to maintain a given static-pressure difference is significantly increased. In turn, the large increase in required air volume necessitates a great increase in fan capacity to cool a given quantity of fruit. Since more power is needed, the cost is greater.

Thus, ideally and for maximum efficiency in a forced-air system, the only air that should be permitted to pass through the pallet of containers is that which comes into direct contact with the fruit. Ideally there would be no air gap between juxtaposed containers which will be used in forced air cooling. There is thus a need for a stackable and nestable container which is suitable for storing perishable food items and which minimizes the detrimental air flow loss when the container is subjected to a forced air cooling process.

SUMMARY OF THE INVENTION

Accordingly, it is a principal object of the present invention to provide a stackable and nestable container which is specifically adapted to receive perishable food items which require the circulation of a cooled air flow.

It is a further object of the present invention to provide such a stackable and nestable container that is configured so as to closely abut a similarly shaped container when the containers are juxtaposed on a pallet, such that the air flow lost between the containers is minimized when the containers are subjected to a forced air cooling process.

It is also a further object of the present invention to provide such a stackable and nestable container that achieves the above objects and is also of a sufficient strength so that a plurality of containers may be stacked thereon. The container should also be easily capable of being secured in a nested configuration.

Another object of the present invention is to provide such a stackable and nestable container that is free of any sharp or rough internal surfaces so that perishable food items stored therein are not damaged when brought into contact with those internal surfaces.

Directed to achieving these objects, a novel container is herein provided. The container comprises a bottom surface and two pairs of opposed side walls integrally joined with the bottom surface. The side walls extend upwardly away from the bottom surface and are integrally joined with each other along common end surfaces. Thus, the side walls and the bottom surface form a substantially rectangular open-top container. Further, the bottom surface is apertured to allow for air circulation between containers when stacked.

The uppermost surfaces of the side walls collectively form an upper container rim. A container lid is adapted to be received along the upper container rim. Also, each side wall includes a dropped wall section in a central portion thereof along the upper container rim. The dropped wall section comprises a portion of the side wall where the upper container rim is recessed a predetermined distance from its upper surface downwardly towards the container bottom surface. The dropped wall section serves three important functions. First, it facilitates easy removal of the container lid. Second, it gives the container a full appearance after the perishable food items therein have settled. Finally, the dropped wall section aids in the circulation of a cooled air flow to the container.

Ventilation apertures are formed in each of the side walls. Also, each side wall includes a pair of column sections. Each column section includes a recessed portion, an inner shelf, and a lower column support. The column sections form outer surfaces which project outwardly away from the side walls.

By using the column section design, all the support geometry for the container is located in the corners of the substantially rectangular open-top container. Conveniently, two of the opposing panels may be used for venting in one direction, and the other two panels may be used to display a label.

The recessed portions of the column sections extend downwardly away from the container rim and terminate in the inner shelf. The inner shelf is disposed a predetermined distance above the bottom surface of the container. The lower column support comprises a pair of mutually spaced walls or a double wall of material and is disposed below the recessed portion and adjacent the bottom surface. The inner shelf forms the uppermost surface of each lower column support, and the lowermost surface of each lower column support comprises an aperture.

The recessed portions of the column sections are adapted to receive corresponding portions of a similarly shaped container when the containers are placed in a nested configuration. The upper container is received within the corresponding recessed portions in the lower container and rests upon the corresponding inner shelves of the lower container.

The upper container rim comprises a double wall of material around substantially its entire periphery. The remaining portion of the periphery comprises a single thickness of material. The upper container rim comprises a single thickness of material only along those surfaces located adjacent to the recessed portions of the column sections.

With the above design, the double wall construction of substantially the entire upper container rim provides the container with sufficient high strength for stacking. Further, the single thickness recessed portions of the column sections provide suitable surfaces for a nesting configuration. However, the high strength of the container is maintained in these potentially weak single thickness areas by the double wall construction of the lower column supports.

Also, with the novel double to single thickness design, the outer surfaces of the column sections are configured so as to closely abut the column sections of a similarly shaped container when the containers are juxtaposed. In this manner, when a cooled air flow is directed towards the juxtaposed containers, the majority of the cooled air flow is directed through the side wall apertures and over the perishable food items. Thus, the cooled air flow lost between the juxtaposed containers is minimized.

The container lid is adapted to be removably received on the upper container rim. The lid includes a lip which fits into a recessed acceptance area around the rim of the container. This arrangement ensures that the lid and upper rim present a flat surface when interfitted so that an adjacent container will lie flush against the rim and lid when placed on a pallet. Further, the lid is designed to fit securely on the upper container rim during routine shipping, and also be easily removed so that the containers may be opened for inspection.

The lid also includes container lid projections on its upper surface. The container lid projections are adapted to be received within the lower column support apertures of a similarly shaped container when the containers are disposed in a stacked configuration. The lid further includes raised diamond projections that extend upwardly away from its upper surface. These diamond projections are designed to interface with corresponding gridwork located below the bottom surface of a similarly shaped container placed above in a stack. In this manner, a container may be located on the lid of a container below and then slid into place in the various projection and aperture interfaces. It is then difficult for the container to slide in any direction thereafter.

The surface of the container lid is preferably formed in a lattice shape to allow for the ready circulation of air throughout a covered container. Thus, in a stacked configuration, air is allowed to freely flow between the apertured bottom surface of a first container and through the latticed container lid of a second similarly shaped container.

Other objects and advantages of the present invention will become more apparent to those persons having ordinary skill in the art to which the present invention pertains from the following description taken in conjunction with the accompanying drawings.

DETAILED DESCRIPTION OF THE INVENTION

Figure 8B:
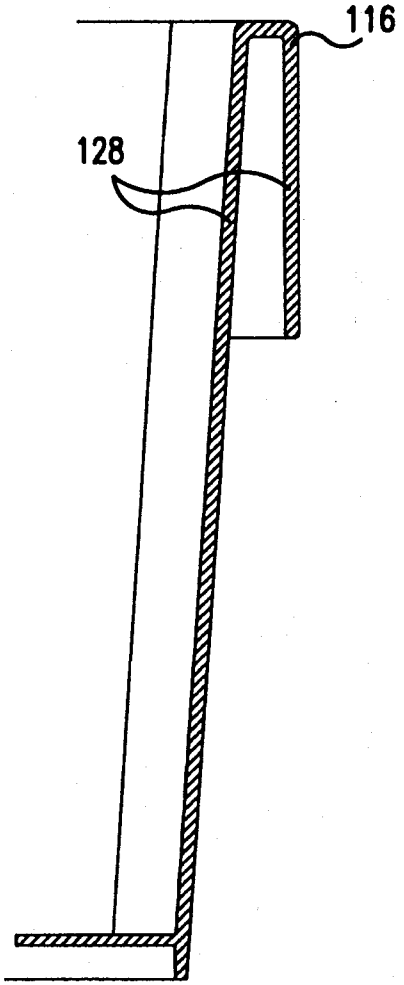
FIG.8B PRIOR ART
FIG. 8 shows the double wall construction of a conventional prior art container.
Figure 8A:
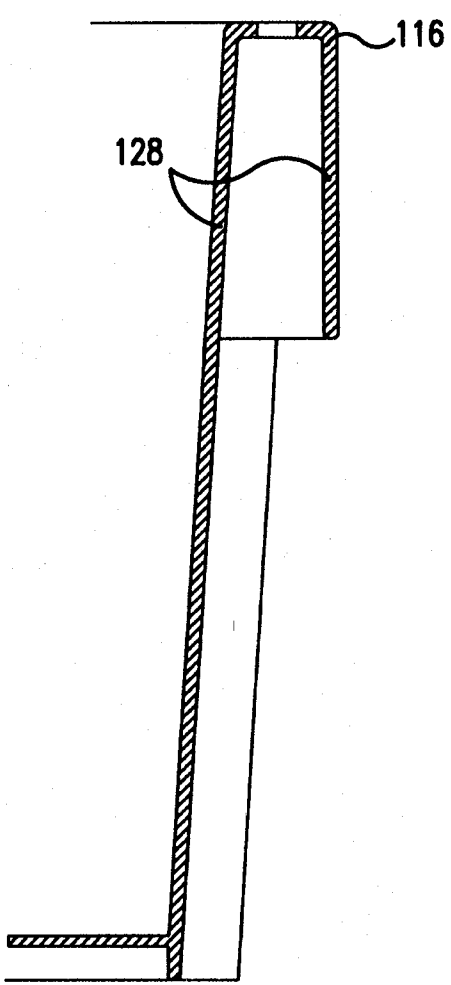
FIG.8A PRIOR ART

A common method of achieving a high strength container is to utilize a double wall construction around the entire periphery of the upper container rim. A typical double wall construction is shown in FIG. 8. A double thickness of material (128) is used around the entire periphery of the upper rim (116) of the prior art container.

Unfortunately, this construction is not practicable where the container will be used to store grapes. As discussed above, a grape lug must be subjected to forced air cooling in the initial stage of the grape shipping process.

Again, the principle behind forced air cooling is that a vacuum is created on one side of a wall of pallets of grapes while cold air is pumped in from the other side of the pallets. This means that air must flow through vents on one side of the container and pass through the inside of the container before flowing towards the vacuum on the opposite side of the pallet.

Figure 12:
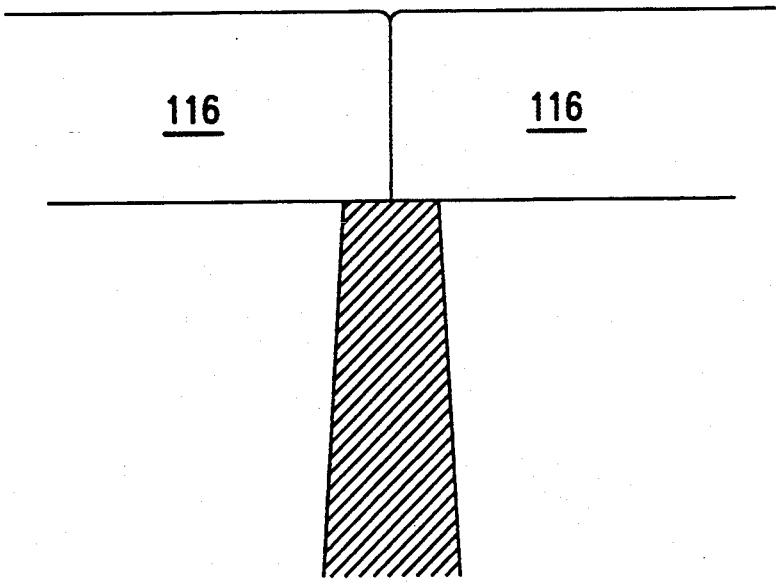
FIG. 12 PRIOR ART
FIG. 12 is an end elevational view, with portions thereof broken away, of a pair of adjacent stackable and nestable prior art containers.

Because of the nature of this process, the forced air cooling method is less effective when the containers don't adequately butt up against each other. If the containers are widely spaced, the air flow will take the path of least resistance between the packages and thus bypass coming into contact with the grapes. As shown in FIG. 12, this is the undesirable result when a double wall construction is used around the entire upper rim (116) of a container.

The present invention forges a compromise between the desirable strength characteristics afforded by the double wall construction and the undesirable effect of an air gap between abutting containers. A small gap does exist between the containers of the present invention, but this design presents a suitable compromise between structural strength and the minimization of the air flow lost between containers.

In addition to strength and the reduction of lost air flow, the present design allows the container to assume a nesting configuration with a similarly shaped container. A non-nestable high-strength container with no air gap could easily be formed. However, nesting is a necessary :feature for a container which must be conveniently stored when not in use.

Figure 1:
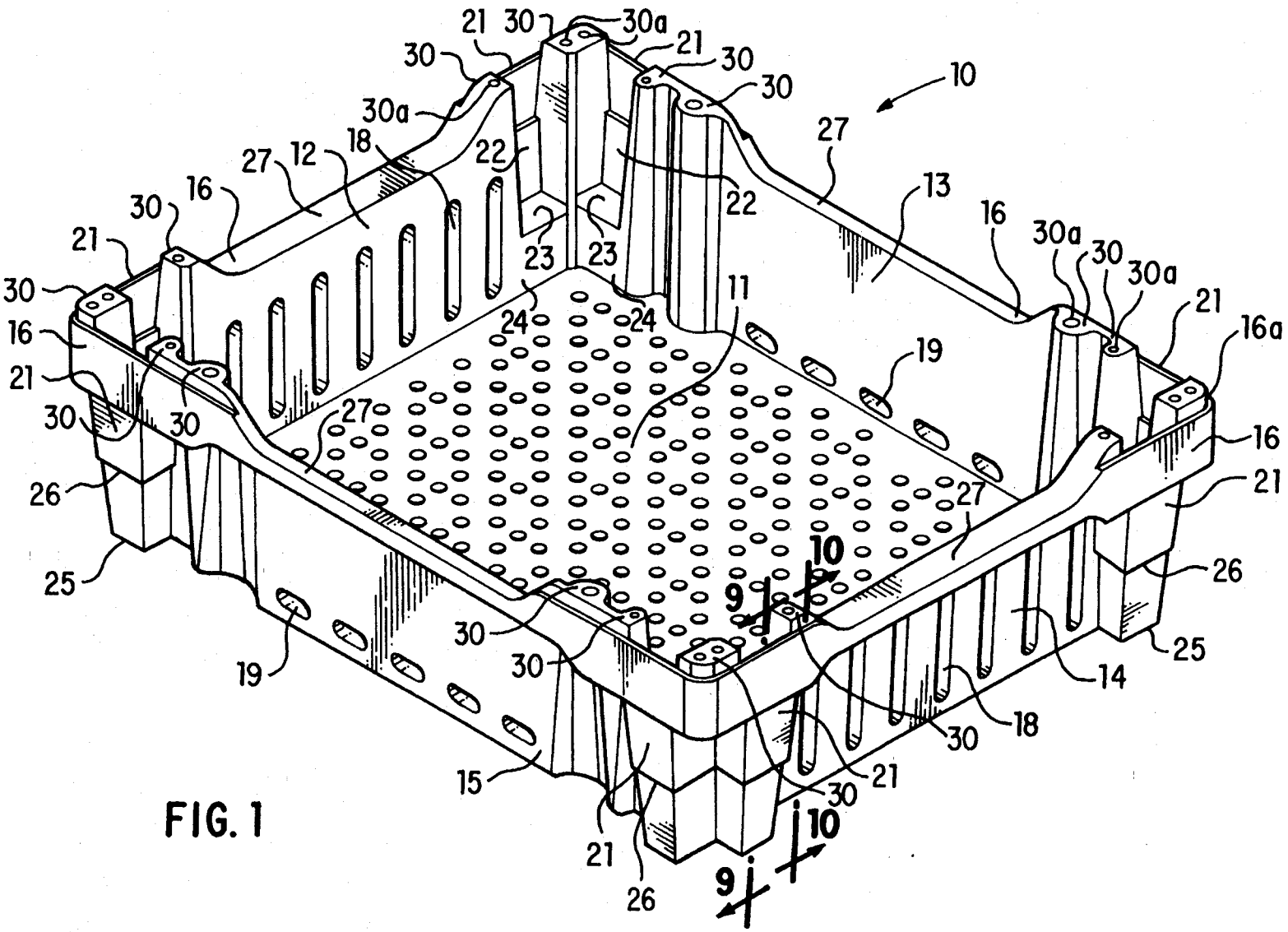
FIG. 1 is a top perspective view of the stackable and nestable container of the present invention shown without the container lid in place.
Figure 1A:
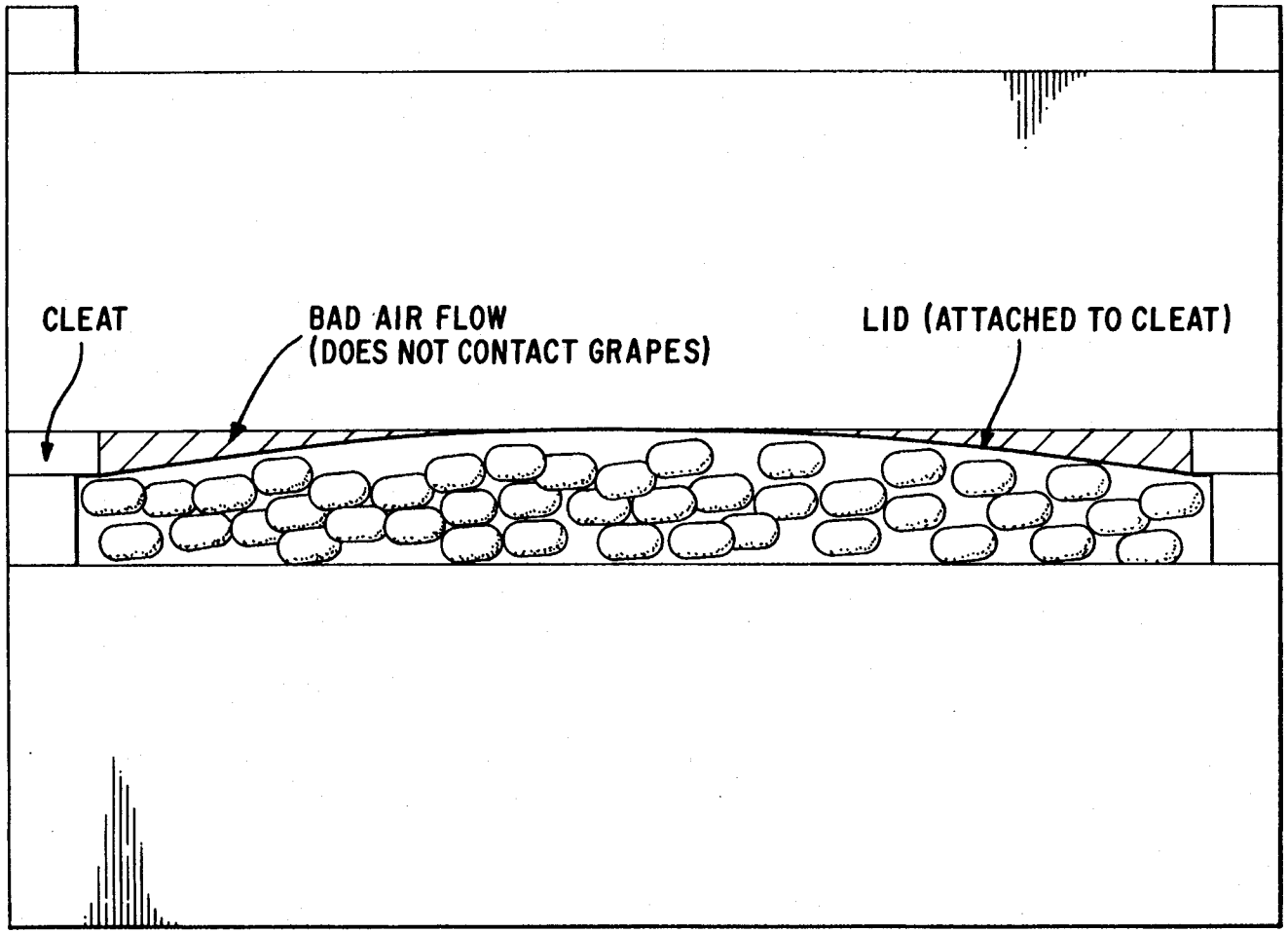
FIG. 1A is an illustration of a prior art design.
Figure 2:
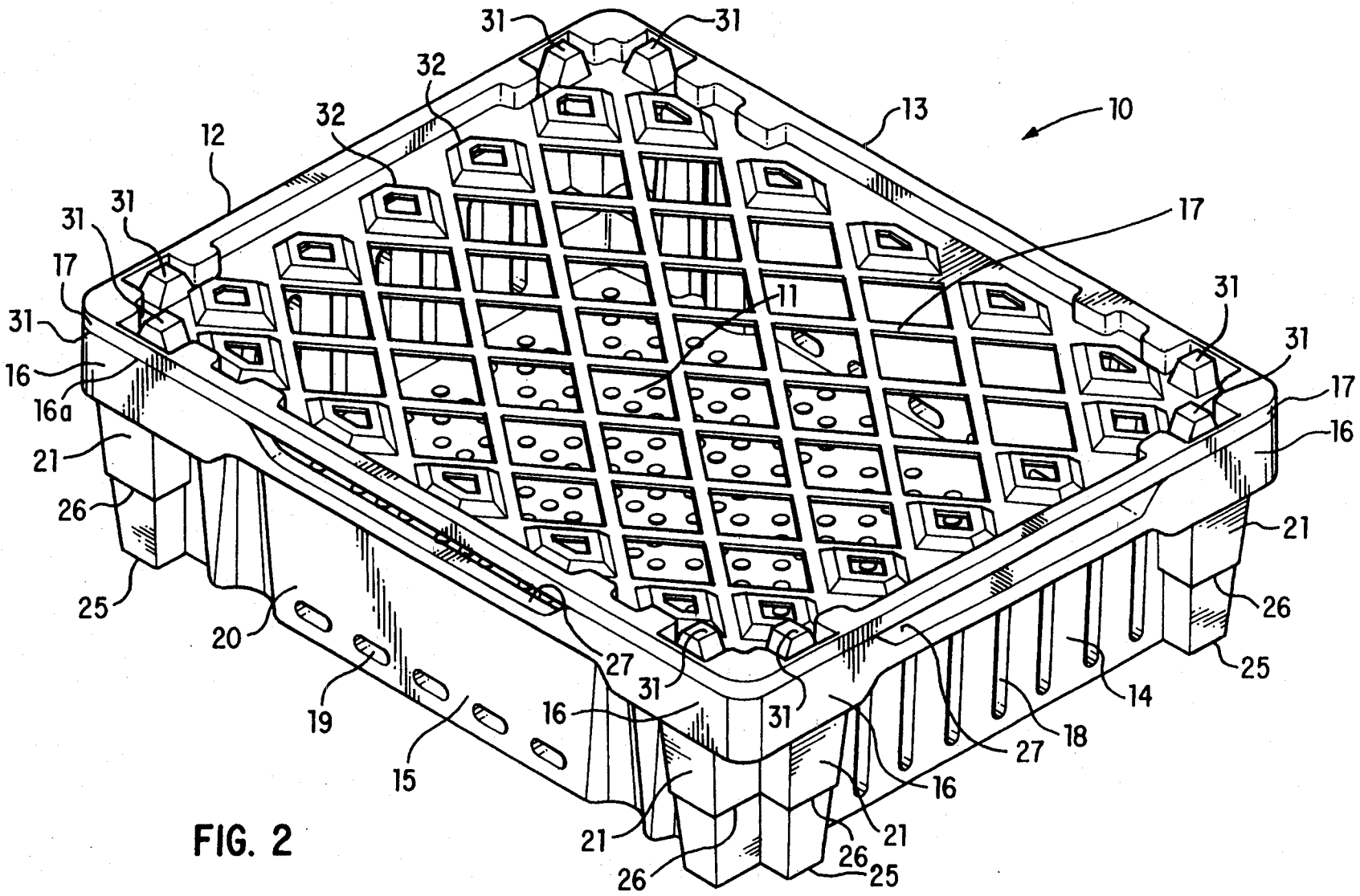
FIG. 2 is a top perspective view of the stackable and nestable container of the present invention shown with the container lid in place.
Figure 5:
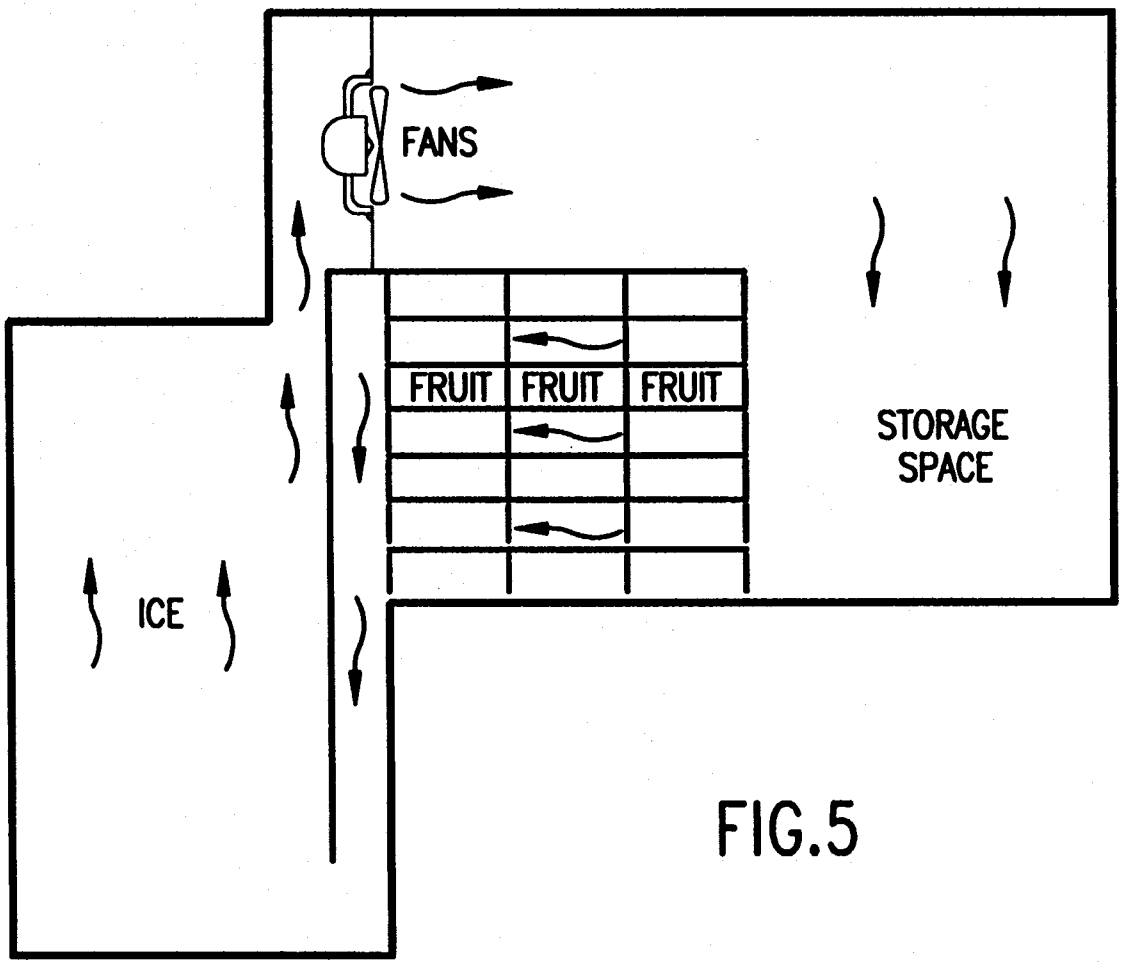
FIG. 5 shows the principle of the; forced air cooling method.
Figure 6:
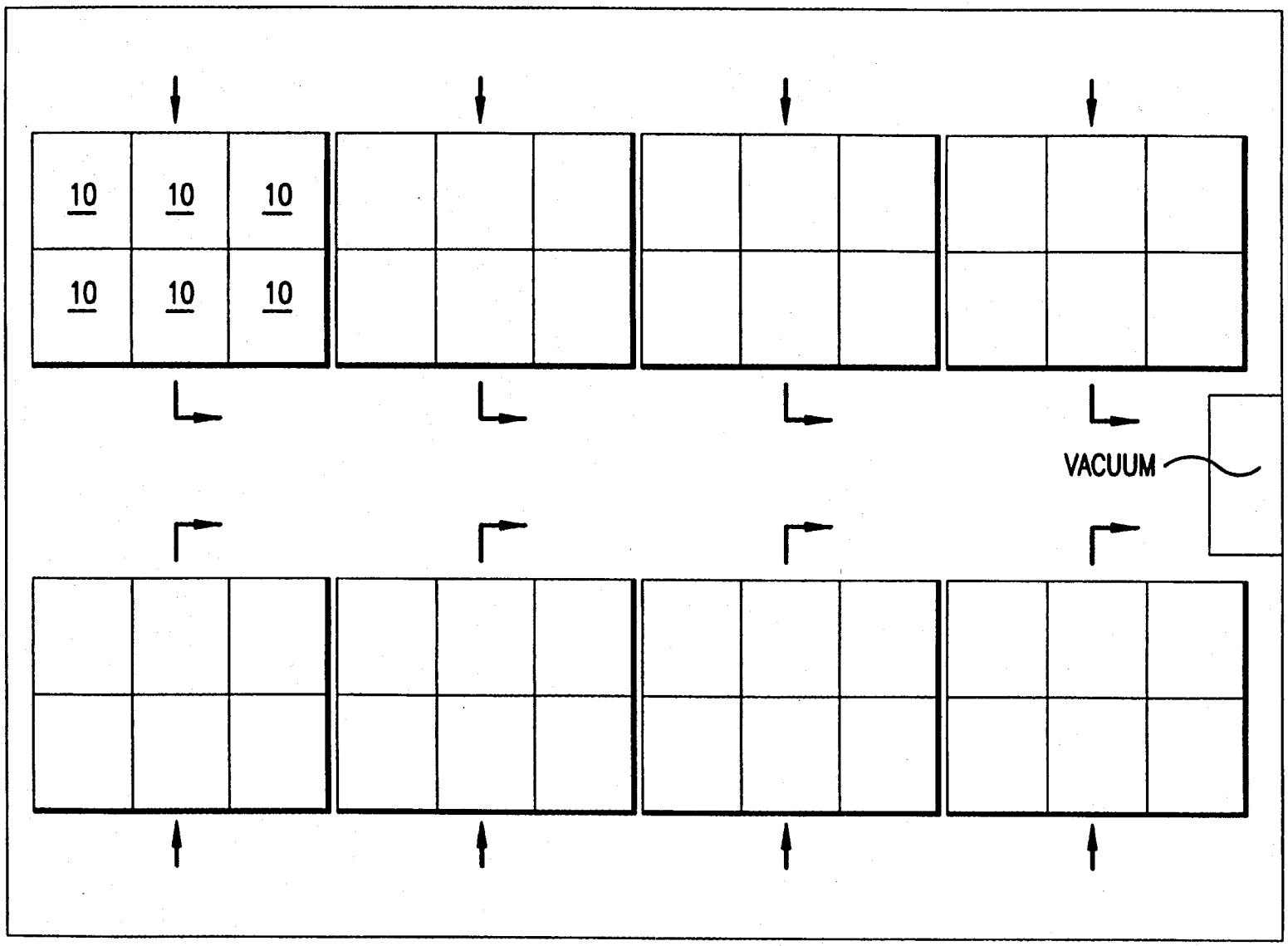
FIG. 6 shows the container of the present invention in a first orientation within a forced air cooling system.
Figure 7:
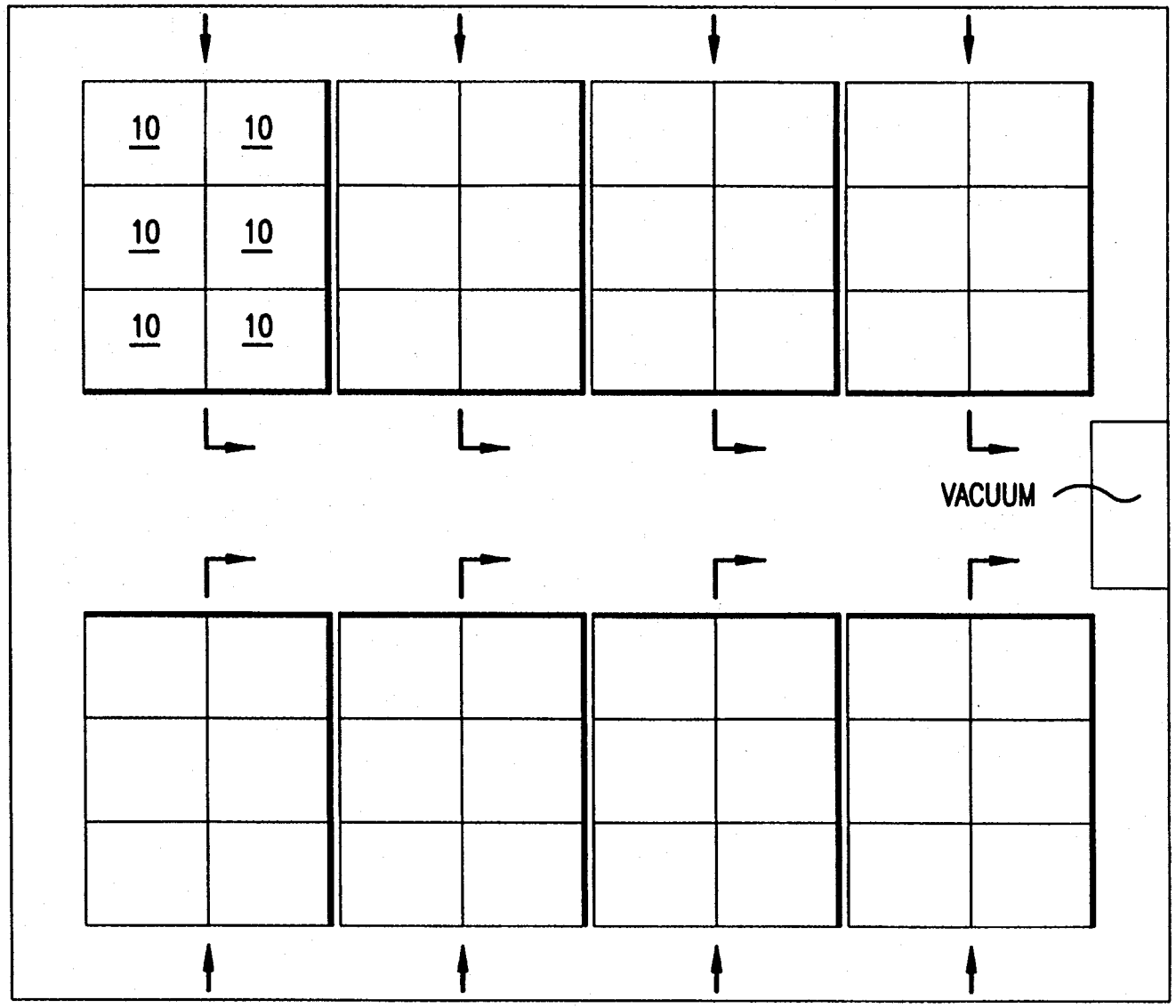
FIG. 7 shows the container of the present invention in a second orientation within a forced air cooling system.

The container (10) of the present invention is shown in FIGS. 1 and 2. This container (10) is suitable for storage of any food item, but it is particularly suitable for the storage of perishable food items requiring the circulation of a cooled air flow. This container (10) is especially adapted for the storage of grapes which will be subjected to the forced air cooling process shown in FIGS. 5–7.

The container (10) comprises a bottom surface (11), a first pair of opposed side walls (12, 14), and a second pair of opposed side walls (13, 15). The pairs of opposed side walls (12, 13, 14, 15) are integrally joined with the bottom surface (11) and extend upwardly away therefrom. The pairs of opposed side walls (12, 13, 14, 15) are also integrally joined with each other along common end surfaces. Thus the side walls (12, 13, 14, 15) and bottom surface (11) together form a substantially rectangular open-top container (10). The bottom surface is apertured to allow for air circulation between containers when stacked.

The uppermost surfaces of the side walls (12, 13, 14, 15) collectively form an upper container rim (16). A container lid (17) is adapted to be removably received along the upper container rim (16). Each side wall (12, 13, 14, 15) further includes a dropped wall section (27) along a central portion thereof. The dropped wall section (27) comprises a portion of the side wall (12, 13, 14, 15) where the upper container rim (16) is recessed a predetermined distance from its upper surface downwardly towards the container bottom surface (11). The dropped wall section (27) facilitates easy removal of the container lid (17), gives the container a full appearance after the perishable food items therein have settled, and, as explained more fully below, aids in the circulation of a cooled air flow.

The side walls (12, 13, 14, 15) also include projections (30) which extend upwardly away from the upper container rim (16). Each side wall projection (30) also includes at least one projection aperture (30*a*). As discussed more fully below, the side wall projections (30) are adapted to be received within corresponding recessed apertures in the lower surface of the container lid (17) when the container lid (17) is used to cover the container (10).

The first pair of opposed side walls (12, 14) each include a plurality of ventilation apertures (18) formed in a central portion thereof below the dropped wall section (27). Similarly, each wall of the second pair of side walls (13, 15) also includes ventilation apertures (19) disposed below the respective dropped wall section (27). Each wall of the second pair of side walls (13, 15) also includes a substantially flat open surface area which may be used to display a label (20).

Each of the side walls (12, 13, 14, 15) includes a pair of column sections (21) disposed near the corners of the rectangular container (10). As best shown in FIG. 1, each column section (21) is comprised of a recessed portion (22), an inner shelf (23) and a lower column support (24).

The recessed portion (22) of each column section (21) extends downwardly away from the upper container rim (16) and terminates in an inner shelf (23). The inner shelf (23) is disposed a predetermined distance above the bottom surface (11) of the container (10). The column sections (21) further comprise a lower column support (24). This lower column support (24) is made up of a double wall of container material. The lower column support (24) is disposed below the recessed portion (22) in the column section (21) and adjacent the bottom surface (11) of the container. The inner shelf (23) forms the uppermost surface of the lower column support (24), while the lowermost surface of each lower column support (24) comprises an aperture (25).

By using the column section (21) design, all the support geometry for the container is located in the corners of the substantially rectangular open-top container. Thus, a flat panel is provided between the column sections (21) along each side wall (12, 13, 14, 15). Conveniently, and in a preferred embodiment, two of the opposing panels may be used for venting in one direction, and the other two panels may be used to display a label (20).

The column sections (21) form outer surfaces (26) which project outwardly away from the side walls (12, 13, 14, 15). As discussed more fully below, the outwardly projecting profile of these outer surfaces (26) is essential to assuring the maximum possible cooling air flow.

The recessed portions (22) of the column sections (21) are adapted to receive corresponding portions of a similarly shaped container when the containers are placed in a nested configuration. The outer surfaces (26) of the column sections (21) of an upper container are received within the corresponding recessed portions (22) in the column sections (21) of a lower container. When nested, the upper container rests upon the corresponding inner shelves (23) of the lower container.

Figure 10:
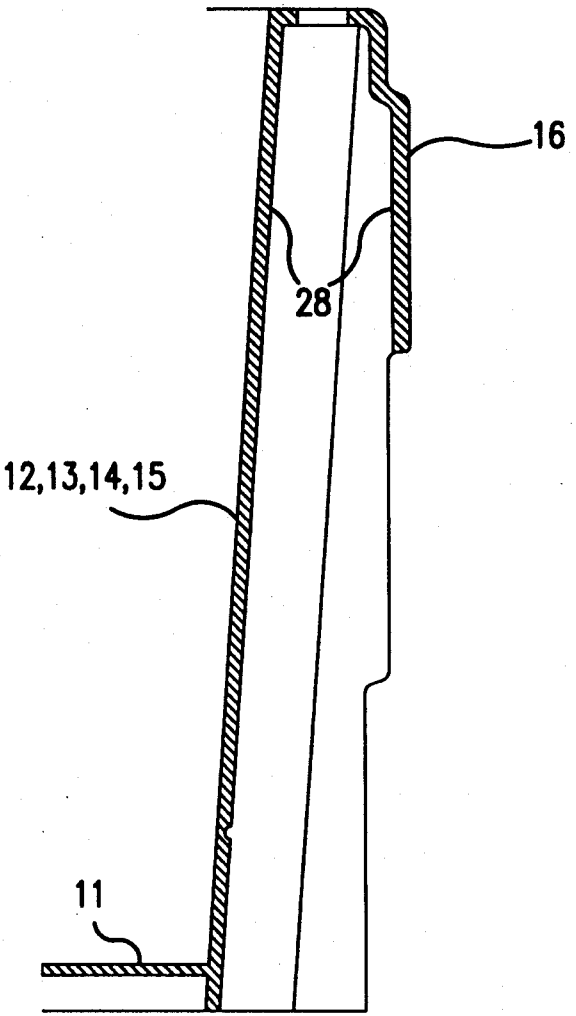
FIG. 10 is a cross-sectional view taken along line 10—10 of FIG. 1.

The upper container rim (16) comprises a double thickness of material (28) around substantially its entire periphery. The remainder of the periphery of the upper container rim (16) comprises only a single thickness of material (29). As best shown in FIG. 10, the upper container rim (16) comprises a single thickness of material (29) only along those surfaces located adjacent to the recessed portions (22) of the column sections (21).

This novel double to single thickness construction serves several important functions. First, the double wall construction (28) around substantially the entire periphery of the upper container rim (16) provides sufficient strength to the container for stacking. Second, the single thickness construction (29) in the areas of the column sections (21) allows the container to easily assume a nesting configuration with a similarly shaped container. Third, the double thickness construction (28) of the lower column support (24) maintains the overall high strength of the container in the potentially weak single thickness areas (29) formed by the recessed portions (22) of the column sections (21). Fourth, the novel double to single thickness construction provides a column section (21) with an outer surface (26) that projects outwardly away from the side walls (12, 13, 14, 15) such that the container will closely abut with a similarly shaped container. Finally, the double thickness construction of the lower column support (24) provides the container with a smooth lower internal surface that will not damage perishable food items that come into contact therewith. These features are discussed more fully below.

Ideally, for maximum strength, the container would comprise a double thickness of material around the entire periphery of the upper rim. The double wall construction method typically provides a sufficiently high strength to a container for stacking with the minimum expense of raw materials. However, the container of the present invention will be used to store grapes during a forced air cooling process. Thus, for efficient and maximum air flow, the container must be capable of closely abutting a similarly shaped container when the containers are stacked on a pallet. As shown in FIG. 12, a double wall construction (128) around the entire rim (116) is ineffective in this regard. In addition, the container must be capable of attaining a nesting configuration to provide for easy storage when not in use. The container of the present invention achieves these objects in the following manner.

By utilizing a double thickness (28) around substantially the entire periphery of the upper container rim (16), the present design takes advantage of the high strength characteristics of the double wall construction method. Thus, the container (10) is of sufficient strength for stacking a plurality of containers thereon. The container is capable of achieving a top strength of approximately 800–1000 lbs and, unlike other prior art grape lugs, is stackable three pallets high.

The recessed portions (22) of the column sections (21) where the upper container rim (16) comprises only a single thickness (29) also serve a vital function to the present design. These portions (22) provide suitable receiving surfaces for a similarly shaped container when the containers are placed in a nesting configuration. Furthermore, the single thickness (29) section desirably terminates in the inner shelf (23). The shelf (23) itself serves two important functions. First, the shelf (23) helps to stabilize the entire column section (21) and make this section rigid. Second, and more importantly, the shelf (23) acts as a "step" on which a nesting upper container rests. This shelf (23) or "step" creates a flat surface so that nesting boxes rest squarely without riding up on each other.

Figure 9:
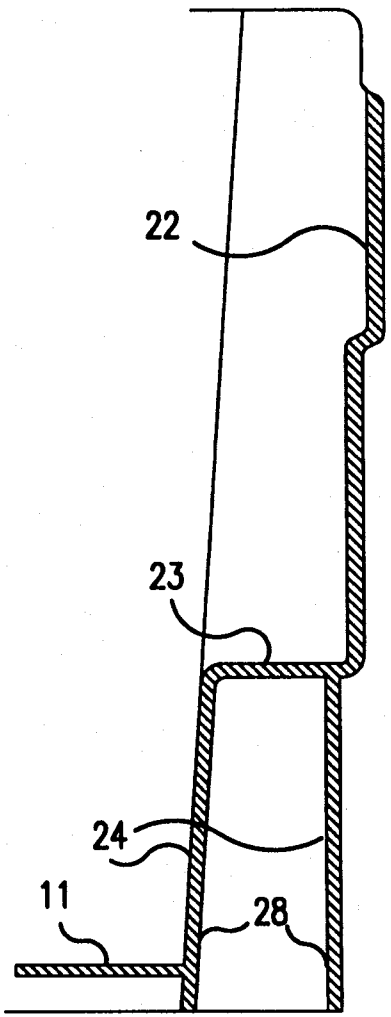
FIG. 9 is a cross-sectional view taken along line 9—9 of FIG. 1.

Even though the high strength double thickness construction is not used around the upper container rim (16), the high strength quality of the container (10) is maintained. In the potentially weak single thickness areas (29) around the column sections (21), a double thickness construction (28) is employed in the lower column supports (24) along the bottom surface of the container (10). This configuration is best shown in FIG. 9.

The double wall construction (28) along the lower column supports (24) actually serves two important functions. First, it effectively "ties" together the break in the double wall along the upper container rim (16), thus minimizing the effect of a potential weak spot. Second, as shown in FIG. 9 and unlike a typical double wall container, it eliminates the negative effects of contoured walls in the interior bottom third of the crate. Since any curves, corners, or edges pose the potential risk of bruising or otherwise damaging the perishable food items within the container, a smooth wall is the best way to protect quality. This is most important towards the bottom of the container, where the weight from the food items above creates the greatest pressure on the food items below.

Figure 3:
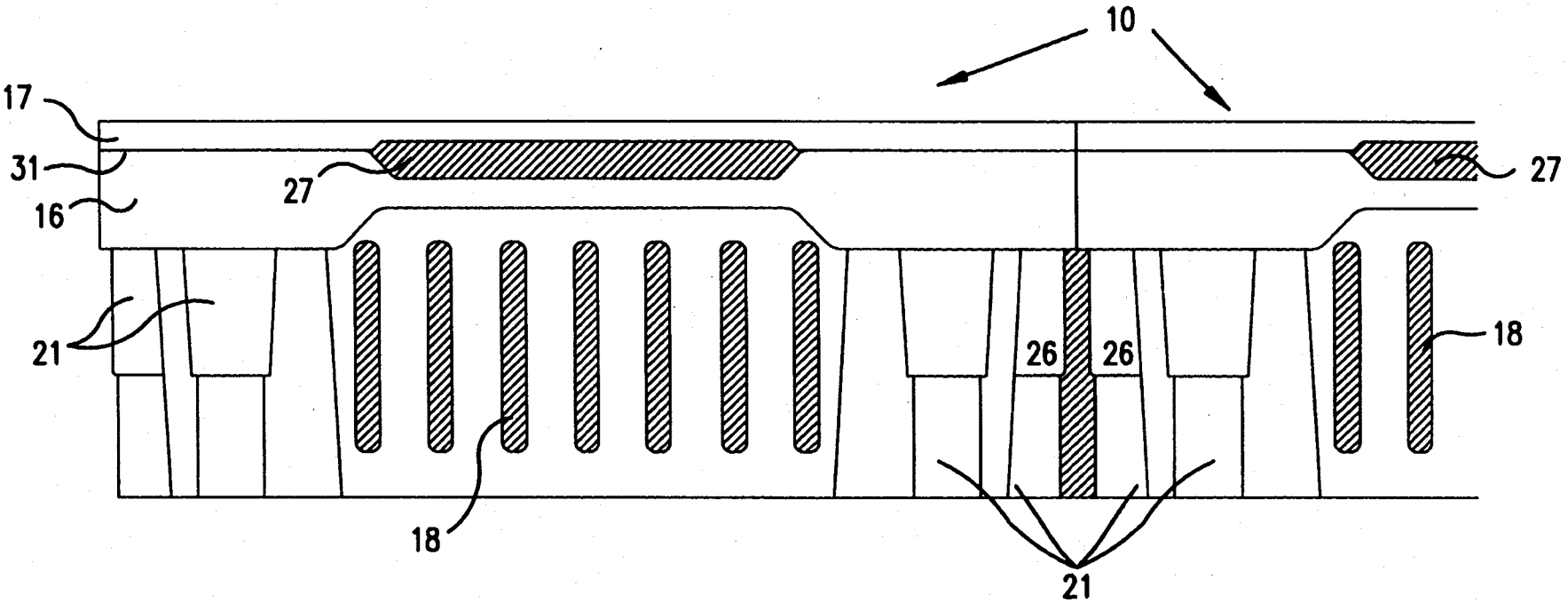
FIG. 3 is an end elevational view, with portions thereof broken away, of a pair of adjacent stackable and nestable containers of the present invention.
Figure 4:
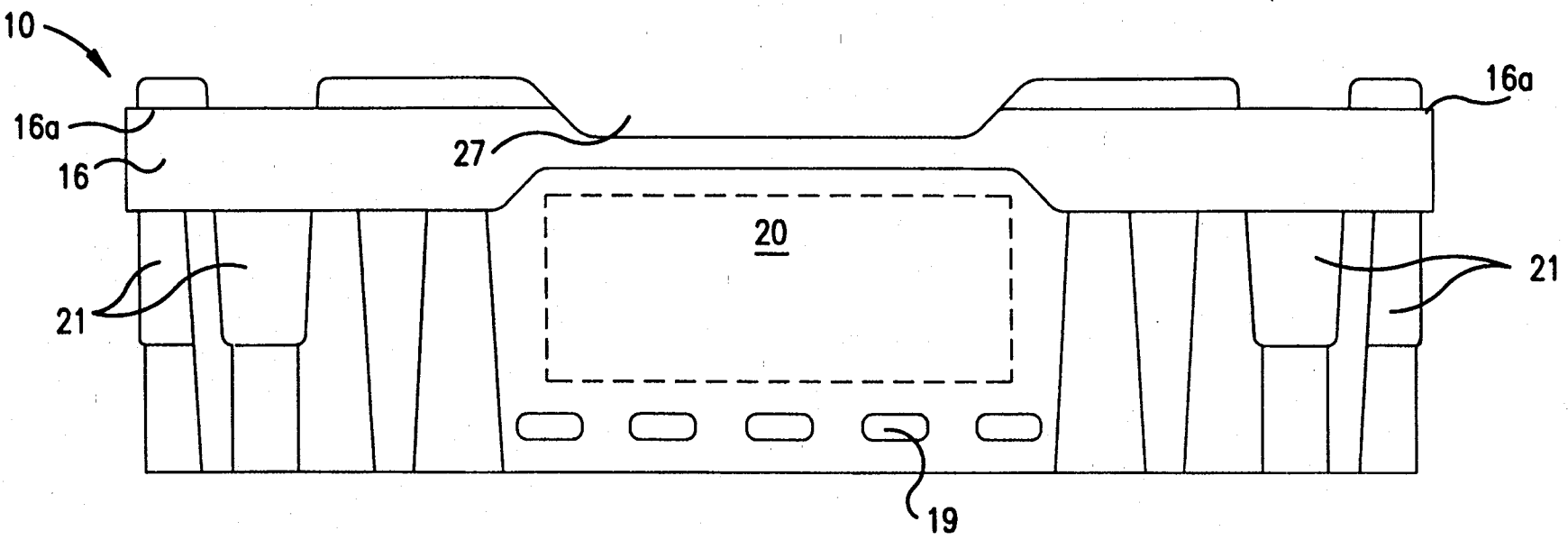
FIG. 4 is a side elevational view of the stackable and nestable container of the present invention.
Figure 11:
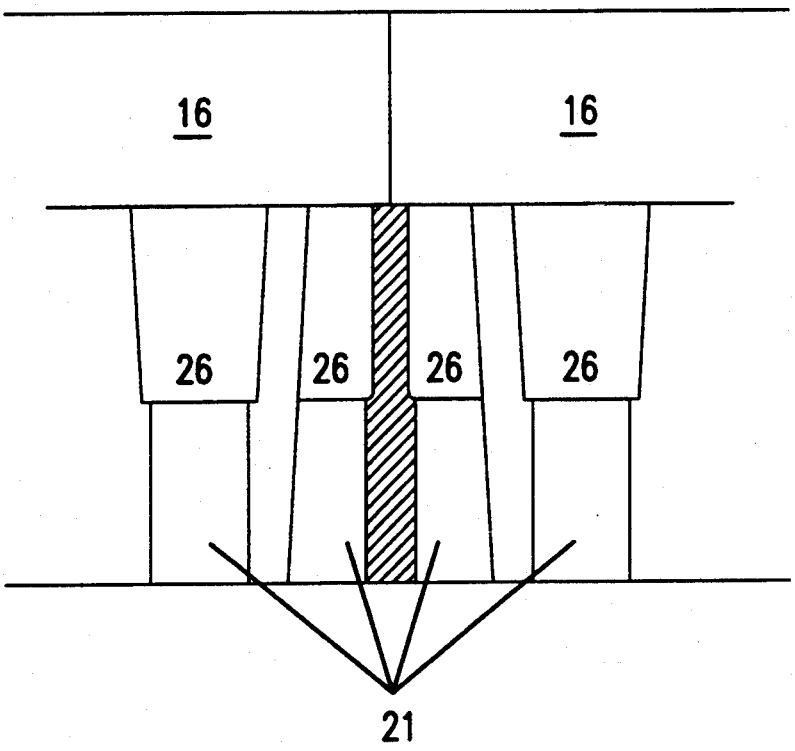
FIG. 11 is an end elevational view, with portions thereof broken away, of a pair of adjacent stackable and nestable containers of the present invention.

In addition to the above advantages, the novel double to single thickness construction design is vital to the effectiveness of the forced air cooling process performed on the perishable food items held within the container. Because a single thickness (29) of material is used around the upper container rim (16) at selected locations, when two similarly shaped containers butt-up side by side (as shown in FIGS. 3 and 11), there is a minimal air gap between them. Comparatively, as shown in FIG. 12, the prior art double wall containers necessitate substantially larger air gaps between juxtaposed containers.

More specifically, the column sections (21) are configured so as to form outer surfaces (26) which project outwardly away from the respective side walls (12, 13, 14, 15). Because of the double to single thickness construction, these outer surfaces (26) will closely abut with the outer surfaces (26) of an adjacent container placed on a pallet. In this manner, when a cooled air flow is directed towards the juxtaposed containers, the majority of the cooled air flow is directed through the side wall apertures (18 or 19) and over the perishable food items. The cooled air flow lost between the juxtaposed containers is thus minimized.

In a further aspect of the present invention, the container lid (17) is adapted to be removably received on the upper container rim (16). The lid includes a top surface and a bottom surface. The lid (17) further includes a lip (31) which fits into a recessed acceptance area (16*a*) around the rim (16) of the container. This arrangement ensures that the lid (17) and upper rim (16) present a flat surface when interfitted so that an adjacent container will lie flush against the rim (16) and lid (17) when placed on a pallet.

On its lower surface, the lid includes a plurality of tab projections disposed within a plurality of recessed apertures. The recessed apertures are adapted to receive corresponding side wall projections (30) when the lid (17) is used to cover the container (10). Further, the tab projections are adapted to be securely received within the corresponding side wall projection apertures (30*a*) of the container to be covered. In this manner, the lid fits securely to the container during routine shipping, but is easily removed so that the containers may be opened for inspection.

The container lid (17) also includes; container lid projections (31) on its upper surface. The container lid projections (31) are adapted to be received within the lower column support apertures (25) of a similarly shaped container when the containers are disposed in a stacked configuration. The lid (17) also includes raised diamond projections (32) that extend upwardly away from its upper surface. These diamond projections (32) are designed to interface with corresponding gridwork located below the bottom surface of a similarly shaped container placed above in a stack. In this manner, a container may be located on the lid (17) below and then slid into place in the various projection and aperture interfaces. It is then difficult for the container to slide in any direction thereafter.

The surface of the container lid (17) is preferably formed in a lattice shape to allow for the ready circulation of air throughout a covered container. Thus, in a stacked configuration, air is allowed to freely flow between the apertured bottom surface (11) of a first container and through the latticed container lid (17) of a second similarly shaped container.

The container (10) may be used in one of two configurations during the forced air cooling process. Either pair of side walls (12, 14 or 13, 15) may be oriented to receive the cooling air flow. In a first and preferred configuration, the first pair of side walls (12, 14) are situated to receive the cooling air flow. Thus, cooled air is forced through the container (10) via the ventilation apertures (18) and the open space defined by the dropped wall sections (27) on each respective side (12, 14). This arrangement provides for the maximum possible flow of cooled air to the container (10). A pallet of containers (10) is shown in this forced air cooling configuration in FIG. 6.

An alternative and less preferred configuration orients the second pair of side walls (13, 15) to receive the cooled air flow. With this configuration, air is forced through the container via the ventilation apertures (19) and the open spaces defined by the dropped wall sections (27) on each respective side wall (13, 15). However, a lesser amount of cooled air flow is allowed through the container (10) with this arrangement since the ventilation apertures (19) are smaller in size than those (18) in the other pair of side walls (12, 14). These apertures (19) are smaller so that a label (20) may be placed along an open surface area of these side walls (13, 15) The label (20) thus takes up an amount of space which cannot be used for ventilation. A pallet of containers (10) is shown in this forced air cooling configuration in FIG. 7.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A stackable and nestable container comprising a bottom surface, a first pair of opposed side walls integrally joined with said bottom surface and extending upwardly away therefrom, a second pair of opposed side walls integrally joined with said bottom surface and extending upwardly away therefrom, said first and second pairs of opposed side walls being integrally joined with each other along common end surfaces thereof to form with said bottom surface a substantially rectangular open-top container, the uppermost surfaces of said first and second pairs of opposed side walls collectively forming an upper container rim having a periphery, said upper container rim adapted to receive a container lid, each wall of said first and second pairs of opposed side walls including a pair of column sections, each said column section including a recessed portion, an inner shelf and a lower column support said recessed portions extending downwardly away from said container rim and terminating in said inner shelf, said inner shelf being disposed a predetermined distance above said bottom surface of said container, said lower column support comprised of a double thickness of material and disposed below said recessed portion and adjacent said bottom surface, said inner shelf forming the uppermost surface of each said lower column support, said periphery of said upper container rim comprised of a plurality of surfaces, said periphery of said upper container rim comprising a single thickness of material along those surfaces located adjacent to said recessed portions of said column sections, the remaining surfaces of said periphery of said upper container rim comprising a double thickness of material, wherein said stackable and nestable container is adapted to be nestable with a similarly shaped container when said containers are disposed in a nested configuration, said stackable and nestable container adapted to receive said similarly shaped container within the corresponding recessed portions of said column sections of said stackable and nestable container such that said similarly shaped container rests upon the corresponding inner shelves of said stackable and nestable container when said containers are disposed in a nested configuration, wherein the double thickness construction of the remaining surfaces of the periphery of the upper container rim provides the container with sufficient high strength for stacking, wherein the recessed portions of the column sections where said upper container rim comprises only a single thickness of material provide suitable surfaces for a nesting configuration, and further wherein said high strength of said container is maintained in potentially weak areas by the double thickness construction of the lower column supports of the column sections where said upper container rim comprises only a single thickness of material.

2. The stackable and nestable container of claim 1 wherein each wall of said first and second pairs of opposed side walls further includes projections which extend upwardly away from said upper container rim, said side wall projections adapted to be received within recessed apertures formed in a container lid when said container lid is received along said upper container rim.

3. The stackable and nestable container of claim 1 wherein the lowermost surface of each said lower column support comprises an aperture, and wherein said lower column support apertures are adapted to receive projections formed in the container lid of a similarly shaped container when said similarly shaped container and said stackable and nestable container are disposed in a stacked configuration.

4. A stackable and nestable container for perishable food items requiring the circulation of a cooled air flow comprising a bottom surface, a first pair of opposed side wails integrally joined with said bottom surface and extending upwardly away therefrom, a second pair of opposed side wails integrally joined with said bottom surface and extending upwardly away therefrom, said first and second pairs of opposed side walls being integrally joined with each other along common end surfaces thereof to form with said bottom surface a substantially rectangular open-top container, the uppermost surfaces of said first and second pairs of opposed side wails collectively forming an upper container rim having a periphery, said upper container rim adapted to receive a container lid, each wall of said first and second pairs of opposed side walls including apertures formed therein, each wall of said first and second pairs of opposed side walls further including a pair of column sections, each said column section including a recessed portion, an inner shelf and a lower column support, said recessed portions extending downwardly away from said container rim and terminating in said inner shelf, said inner shelf being disposed a predetermined distance above said bottom surface of said container, said lower column support comprised of a double thickness of material and disposed below said recessed portion and adjacent said bottom surface, said inner shelf forming the uppermost surface of each said lower column support, said periphery of said upper container rim comprised of a plurality of surfaces, said periphery of said upper container rim comprising a single thickness of material along those surfaces located adjacent to said recessed portions of said column sections, the remaining surfaces of said periphery of said upper container rim comprising a double thickness of material, wherein said stackable and nestable container is adapted to be nestable with a similarly shaped container when said containers are disposed in a nested configuration, said stackable and nestable container adapted to receive said similarly shaped container within the corresponding recessed portions of said column sections of said stackable and nestable container such that said similarly shaped container rests upon the corresponding inner shelves of said stackable and nestable container when said containers are disposed in a nested configuration, wherein said column sections form outer surfaces which project outwardly away from said side walls, and wherein said outer surfaces of said column sections are configured to closely abut the column sections of a similarly shaped container when said containers are juxtaposed, such that when a cooled air flow is directed towards said juxtaposed containers the majority of the cooled air flow is directed through said side wall apertures and over said perishable food items, and such that the cooled air flow lost between the juxtaposed containers is minimized.

5. The stackable and nestable container of claim 4 wherein said lower column support forms a smooth internal surface for said container such that perishable food items placed within said container are not damaged when forced into contact with said lower column support.

6. A stackable and nestable container for perishable food items requiring the circulation of a cooled air flow comprising a bottom surface, a first pair of opposed side walls integrally joined with said bottom surface and extending upwardly away therefrom, a second pair of opposed side walls integrally joined with said bottom surface and extending upwardly away therefrom, said first and second pairs of opposed side walls being integrally joined with each other along common end surfaces thereof to form with said bottom surface a substantially rectangular open-top container, the uppermost surfaces of said first and second pairs of opposed side walls collectively forming an upper container rim having a periphery, said upper container rim adapted to receive a container lid, each wall of said first and second pairs of opposed side walls including apertures formed therein, each wall of said first and second pairs of opposed side walls further including a pair of column sections, each said column section including a recessed portion, an inner shelf and a lower column support, said recessed portions extending downwardly away from said container rim and terminating in said inner shelf, said inner shelf being disposed a predetermined distance above said bottom surface of said container, said lower column support comprised of a double thickness of material and disposed below said recessed portion and adjacent said bottom surface, said inner shelf forming the uppermost surface of each said lower column support, said periphery of said upper container rim comprised of a plurality of surfaces, said periphery of said upper container rim comprising a single thickness of material along those surfaces located adjacent to said recessed portions of said column sections, the remaining surfaces of said periphery of said upper container rim comprising a double thickness of material, wherein said stackable and nestable container is adapted to be nestable with a similarly shaped container when said containers are disposed in a nested configuration, said stackable and nestable container adapted to receive said similarly shaped container within the corresponding recessed portions of said column sections of said stackable and nestable container such that said similarly shaped container rests upon the corresponding inner shelves of said stackable and nestable container when said containers are disposed in a nested configuration, wherein the double thickness construction of the remaining surfaces of the periphery of the upper container rim provides the container with sufficient high strength for stacking, wherein the recessed portions of the column sections where said upper container rim comprises only a single thickness of material provide suitable surfaces for a nesting configuration, wherein said high strength of said container is maintained in potentially weak areas by the double thickness construction of the lower column supports of the column sections where said upper container rim comprises only a single thickness of material, wherein said column sections form outer surfaces which project outwardly away from said side walls, and further wherein said outer surfaces of said column sections are configured to closely abut the column sections of a similarly shaped container when said containers are juxtaposed, such that when a cooled air flow is directed towards said juxtaposed containers the majority of the cooled air flow is directed through said side wall apertures and over said perishable food items, and such that the cooled air flow lost between the juxtaposed containers is minimized.

7. The stackable and nestable container of claim 1 wherein each wall of said first and second pairs of opposed side walls includes apertures formed therein.

8. The stackable and nestable container of claim 1 wherein said bottom surface includes apertures formed therein.

9. The stackable and nestable container of claim 2 wherein ventilation apertures are formed in the container lid received along said upper container rim.

10. The stackable and nestable container of claim 3 wherein ventilation apertures are formed in the container lid of the similarly shaped container.

11. The stackable and nestable container of claim 4 wherein each wall of said first and second pairs of opposed side walls further includes projections which extend upwardly away from said upper container rim, said side wall projections adapted to be received within recessed apertures formed in a container lid when said container lid is received along said upper container rim.

12. The stackable and nestable container of claim 11 wherein ventilation apertures are formed in the container lid received along said upper container rim.

13. The stackable and nestable container of claim 4 wherein the lowermost surface of each said lower column support comprises an aperture, and wherein said lower column support apertures are adapted to receive projections formed in the container lid of a similarly shaped container when said similarly shaped container and said stackable and nestable container are disposed in a stacked configuration.

14. The stackable and nestable container of claim 13 wherein ventilation apertures are formed in the container lid of the similarly shaped container.

15. The stackable and nestable container of claim 4 wherein said bottom surface includes apertures formed therein.

16. The stackable and nestable container of claim 6 wherein each wall of said first and second pairs of opposed side walls further includes projections which extend upwardly away from said upper container rim, said side wall projections adapted to be received within recessed apertures formed in a container lid when said container lid is received along said upper container rim.

17. The stackable and nestable container of claim 16 wherein ventilation apertures are formed in the container lid received along said upper container rim.

18. The stackable and nestable container of claim 6 wherein the lowermost surface of each said lower column support comprises an aperture, and wherein said lower column support apertures are adapted to receive projections formed in the container lid of a similarly shaped container when said similarly shaped container and said stackable and nestable container are disposed in a stacked configuration.

19. The stackable and nestable container of claim 18 wherein ventilation apertures are formed in the container lid of the similarly shaped container.

20. The stackable and nestable container of claim 6 wherein said bottom surface includes apertures formed therein.

* * * * *

UNITED STATES PATENT AND TRADEMARK OFFICE

CERTIFICATE OF CORRECTION

PATENT NO. : 5,415,293

DATED : May 30, 1995

INVENTOR(S) : Jeff Ackermann, et al

It is certified that error appears in the above-indentified patent and that said Letters Patent is hereby corrected as shown below:

Column 12, lines 22 24 and 31, delete "wails" and insert therefore --walls--.

Column 14, line 65, delete "wail" and insert therefore --wall--.

Signed and Sealed this

Eleventh Day of July, 1995

Bruce Lehman

*Attest:*

BRUCE LEHMAN

*Attesting Officer*

*Commissioner of Patents and Trademarks*